US010766069B2

(12) United States Patent
Hayashi et al.

(10) Patent No.: US 10,766,069 B2
(45) **Date of Patent: *Sep. 8, 2020**

(54) METHOD FOR MANUFACTURING ELECTRODE MATERIAL

(71) Applicant: MEIDENSHA CORPORATION, Tokyo (JP)

(72) Inventors: Shota Hayashi, Tokyo (JP); Keita Ishikawa, Tokyo (JP); Kenta Yamamura, Numazu (JP); Kosuke Hasegawa, Numazu (JP); Hideaki Fukuda, Numazu (JP); Akira Sano, Fuji (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/307,538

(22) PCT Filed: Mar. 15, 2017

(86) PCT No.: PCT/JP2017/010426
§ 371 (c)(1),
(2) Date: Dec. 6, 2018

(87) PCT Pub. No.: WO2017/212731
PCT Pub. Date: Dec. 14, 2017

(65) Prior Publication Data

US 2019/0299285 A1 Oct. 3, 2019

(30) Foreign Application Priority Data

Jun. 8, 2016 (JP) ..... 2016-113962

(51) Int. Cl.
*B22F 3/10* (2006.01)
*B22F 1/00* (2006.01)
(Continued)

(52) U.S. Cl.
CPC ..... *B22F 3/10* (2013.01); *B22F 1/00* (2013.01); *B22F 1/0003* (2013.01); *B22F 3/24* (2013.01);
(Continued)

(58) Field of Classification Search
CPC .. B22F 3/10; B22F 3/24; B22F 1/0003; B22F 1/00; C22C 27/06; C22C 1/04;
(Continued)

(56) References Cited

U.S. PATENT DOCUMENTS 4,830,821 A 5/1989 Okutomi et al.
5,330,702 A 7/1994 Kippenberg et al.
(Continued)

FOREIGN PATENT DOCUMENTS

CN 1213153 A 4/1999
EP 2 323 148 A1 5/2011
(Continued)

OTHER PUBLICATIONS

Naya et al., JP-63118032-A. machine translation (Year: 1988).*
(Continued)

*Primary Examiner* — John A Hevey
(74) *Attorney, Agent, or Firm* — Foley & Lardner LLP

(57) ABSTRACT

There is disclosed a method for manufacturing an electrode by pressing and sintering a mixed powder of a solid solution powder of Cr and a heat-resistant element, which contains Cr and the heat-resistant element in a ratio such that Cr is greater than the heat-resistant element by weight, a Cu powder, and a low melting metal powder (Bi, Sn, Se, Pb, etc.). The low melting metal powder of 0.30 weight % to 0.50 weight % is added to a mixed powder of a solid solution powder of Cr and the heat-resistant element and the Cu powder, and then a mixed powder prepared by adding the low melting metal powder is sintered at a temperature of
(Continued)

from 1010° C. to 1035° C. As the low melting metal powder, there is used a powder having a median size of from 5 μm to 20 μm.

4 Claims, 3 Drawing Sheets

(51) Int. Cl.

| | |
|---|---|
| ***B22F 3/24*** | (2006.01) |
| ***C22C 27/06*** | (2006.01) |
| ***H01H 1/02*** | (2006.01) |
| ***H01H 1/025*** | (2006.01) |
| ***B22F 5/00*** | (2006.01) |
| ***C22C 9/00*** | (2006.01) |
| ***C22C 1/04*** | (2006.01) |
| ***C22C 30/02*** | (2006.01) |
| ***B22F 9/08*** | (2006.01) |
| ***H01H 33/66*** | (2006.01) |
| ***H01H 33/664*** | (2006.01) |
| ***H01H 33/662*** | (2006.01) |

(52) U.S. Cl.
CPC ..... *B22F 5/00* (2013.01); *B22F 9/08* (2013.01); *C22C 1/04* (2013.01); *C22C 9/00* (2013.01); *C22C 27/06* (2013.01); *C22C 30/02* (2013.01); *H01H 1/025* (2013.01); *H01H 1/0206* (2013.01); *H01H 33/66* (2013.01); *H01H 33/662* (2013.01); *H01H 33/664* (2013.01)

(58) Field of Classification Search
CPC ..... C22C 9/00; C22C 30/02; H01H 1/025; H01H 33/66; H01H 1/0206
See application file for complete search history.

(56) References Cited

U.S. PATENT DOCUMENTS

| | | | | |
|---|---|---|---|---|
| 5,352,404 | A | 10/1994 | Yoshioka et al. | |
| 6,107,582 | A | 8/2000 | Okutomi et al. | |
| 6,551,374 | B2 | 4/2003 | Doh et al. | |
| 10,153,098 | B2 * | 12/2018 | Hayashi | B22F 1/00 |
| 2002/0068004 | A1 | 6/2002 | Doh et al. | |
| 2002/0144977 | A1 | 10/2002 | Kikuchi et al. | |
| 2005/0092714 | A1 | 5/2005 | Kikuchi et al. | |
| 2008/0166578 | A1 * | 7/2008 | Saxton | B22F 7/08 428/546 |
| 2009/0009852 | A1 | 1/2009 | Honeyman et al. | |
| 2016/0332231 | A1 | 11/2016 | Ishikawa et al. | |
| 2017/0066055 | A1 | 3/2017 | Kitakizaki et al. | |
| 2018/0174771 | A1 | 6/2018 | Hayashi et al. | |
| 2018/0182573 | A1 * | 6/2018 | Hayashi | B22F 1/00 |

FOREIGN PATENT DOCUMENTS

| | | | | | |
|---|---|---|---|---|---|
| JP | 54-147481 | A | | 11/1979 | |
| JP | 63118032 | A | * | 5/1988 | H01H 1/0206 |
| JP | 4-334832 | A | | 11/1992 | |
| JP | 04334832 | A | * | 11/1992 | |
| JP | 5-198230 | A | | 8/1993 | |
| JP | 9-73846 | A | | 3/1997 | |
| JP | 2002-180150 | A | | 6/2002 | |
| JP | 2003-077375 | A | | 3/2003 | |
| JP | 2005-135778 | A | | 5/2005 | |
| JP | 2011-108380 | A | | 6/2011 | |
| JP | 2015-138681 | A | | 7/2015 | |
| JP | 2015-138682 | A | | 7/2015 | |
| JP | 2016-23335 | A | | 2/2016 | |
| JP | 2016-211023 | A | | 12/2016 | |
| JP | 2017-8381 | A | | 1/2017 | |
| JP | 2017-39967 | A | | 2/2017 | |
| WO | WO 2016/178388 | A1 | | 11/2016 | |
| WO | WO 2016/208551 | A1 | | 12/2016 | |

OTHER PUBLICATIONS

Yoshioka et al., JP 04-334832. machine translation. (Year: 1992).*
Werner F. Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vol. 12, No. 5, Jun. 1989, pp. 273-283.
Chinese Office Action and English translation, Application No. 201680036680.X, dated Jul. 11, 2018, 12 pages.
Yoshioka et al., JP 04-334832, published 1992, machine translation (Year: 1992).
European Office Action, Application No. 17809915.6, dated Jun. 2, 2020, 6 pages.
H. Okamoto et al., Cr (Chromium) Binary Alloy Phase Diagrams, ASM Handbook, vol. 3: Alloy Phase Diagrams, pp. 281-297.

* cited by examiner

METHOD FOR MANUFACTURING ELECTRODE MATERIAL

TECHNICAL FIELD

The present invention relates to a method for manufacturing an electrode material, which is used for vacuum interrupters, etc. In particular, it relates to a method for manufacturing an electrode material, which is superior in withstand voltage capability and deposition resistance property, by using an alloy material of copper, chromium and a heat-resistant element (molybdenum, etc.).

BACKGROUND ART

The electrode material (contact material) used for electrodes of vacuum interrupters (VI), etc. is required to satisfy characteristics, such as (1) the breaking capacity being large, (2) the withstand voltage capability being high, (3) the contact resistance being low, (4) the deposition resistance property being high, (5) the contact consumption being low, (6) the chopped current being low, (7) the workability being excellent, and (8) the mechanical strength being high.

Since some of these characteristics conflict with each other, there is no contact material satisfying all of the above characteristics. Cu—Cr electrode materials have characteristics, such as the breaking capacity being large, the withstand voltage capability being high, and the deposition resistance property being high. Therefore, they are widely used as contact materials of vacuum interrupters. Furthermore, there is a report that, in Cu—Cr electrode materials, one having a finer particle size of Cr particles is fine in breaking current and contact resistance (for example, Non-patent Publication 1).

In recent years, there has been progress in making vacuum interrupters conducting arc extinction of vacuum circuit breakers have smaller sizes and larger capacities. Thus, there has been an increasing demand for Cu—Cr based contact materials having withstand voltage capabilities superior to those of conventional Cu—Cr electrode materials, which are essential for making vacuum interrupters have smaller sizes.

For example, in Patent Publication 1, there is described a method to for manufacturing an electrode material, in which, as a Cu—Cr based electrode material excellent in electrical characteristics such as current breaking capability and withstand voltage capability, respective powders of Cu used as a base material, Cr for improving electrical characteristics, and a heat-resistant element (molybdenum (Mo), tungsten (W), niobium (Nb), tantalum (Ta), vanadium (V), zirconium (Zr), etc.) for making the Cr particles finer are mixed together, and then the mixed powder is put into a mold, followed by pressure forming and making a sintered body.

Specifically, a heat-resistant element is added to a Cu—Cr based electrode material containing as a raw material a Cr having a particle size of 200-300 μm, and the Cr is made fine through a fine texture technology. That is, an alloying process of the Cr element and the heat-resistant element is accelerated, and the precipitation of fine Cr—X (X is a heat-resistant element) particles in the inside of the Cu base material texture is increased. As a result, the Cr particles having a diameter of 20-60 μm in a configuration to have the heat-resistant element in its inside are uniformly dispersed in the Cu base material texture. Furthermore, there is also known a method for producing an electrode material (for example, Patent Publication 2) in which, without going through the fine texture technology, a powder obtained by mixing and pulverizing a reaction product of Cr and a heat-resistant element is mixed with a Cu powder, followed by pressure forming and then sintering to manufacture an electrode material containing Cr and the heat-resistant element in the electrode texture similar to Patent Publication 1.

By forming an arc-resistant metal's fine dispersion texture as described in Patent Publication 2, withstand voltage capability and breaking capability are improved, but deposition resistance property may be impaired. An inferior deposition resistance property causes a deposition between the electrodes when applying a large current in a closed condition of the electrodes. This lowering of deposition resistance property causes vacuum circuit breakers to have larger sizes, and this has been a task for mass-production.

Thus, it has been tried to manufacture an electrode material having superior withstand voltage capability and deposition resistance property by adding a low melting metal (e.g., tellurium (Te), etc.) to an electrode material having a MoCr fine dispersion texture (e.g., Patent Publications 3 and 4).

However, in the sintering step of a MoCr fine dispersion electrode material containing a low melting metal added thereto, there was a risk that vacancies were generated in the electrode interior to result in lowering of packing percentage of the electrode material. If packing percentage of the electrode material lowers by the generation of vacancies in the electrode material, there is a risk that brazing material (e.g., Ag) is absorbed into vacancies of the electrode's inside in the brazing step to result in difficulty in brazing of the electrode material.

Furthermore, Te is known to be higher in toxicity, as compared with bismuth (Bi) as a low melting metal similar to Te. For example, oral-mouse-$LD_{50}$ (median lethal dose) of Te is 20 mg/kg (cited from Material Safety Data Sheet (MSDS) of KOJUNDO CHEMICAL LABORATORY CO., LTD). In contrast, oral-mouse-$LD_{50}$ of Bi is 5000 mg/mg or greater (cited from Material Safety Data Sheet (MSDS) of Metali Co., Ltd.). $LD_{50}$ of Te is in excess of 200 times $LD_{50}$ of Bi. If Te is included in controlled substances of foreign REACH (Registration, Evaluation, Authorization and Restriction of Chemicals: REACH regulations) etc., its export limitation is speculated.

PRIOR ART PUBLICATIONS

Patent Publications

Patent Publication 1: JP Patent Application Publication 2002-180150.

Patent Publication 2: JP Patent Application Publication Heisei 4-334832.

Patent Publication 3: JP Patent Application Publication 2015-138682.

Patent Publication 4: JP Patent Application Publication Heisei 5-198230.

Non-Patent Publications

Non-patent Publication 1: Rieder, F. u.a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology, Vol. 12, 1989, 273-283.

SUMMARY OF THE INVENTION

The present invention was made in view of the above situation. Its object is to provide a technology for manufacturing an electrode material that is superior in withstand voltage capability and deposition resistance property, without using Te.

One mode of a method for manufacturing an electrode material of the present invention for achieving the above object comprises the steps of sintering a mixed powder containing a Cr powder and a powder of at least one heat-resistant element selected from the group consisting of Mo, W, Ta, Nb, V, and Zr, the mixed powder containing the Cr and the heat-resistant element in a ratio such that the Cr is greater than the heat-resistant element by weight, thereby making a solid solution of the Cr and the heat-resistant element; pulverizing the solid solution of the Cr and the heat-resistant element to obtain a solid solution powder of the Cr and the heat-resistant element, and then classifying the solid solution powder of the Cr and the heat-resistant element such that a volume-based relative particle amount of particles having a particle size of 90 μm or less becomes 90% or greater; mixing the classified solid solution powder of the Cr and the heat-resistant element, a Cu powder having a median size of 100 μm or less, and a low melting metal powder having a median size of from 5 μm to 20 μm, the low melting metal powder being at least one selected from the group consisting of Bi, Sn, Se and Pb, such that the electrode material contains 39.80 to 89.73 weight % of the Cu, 7.96 to 47.86 weight % of the Cr, 1.99 to 11.96 weight % of the heat-resistant element, and 0.30 to 0.50 weight % of the low melting metal powder; and sintering a compact prepared by pressing a mixed powder obtained by the mixing step, at a temperature of from 1010° C. to 1035° C.

Furthermore, another mode of a method for manufacturing an electrode material of the present invention for achieving the above object is such that, in the above method for manufacturing an electrode material, the low melting metal powder has a median size of from 5 μm to 10 μm.

Furthermore, another mode of a method for manufacturing an electrode material of the present invention for achieving the above object is such that, in the above method for manufacturing an electrode material, the low melting metal powder is a powder produced by an atomization process.

According to the above invention, it is possible to manufacture an electrode material that is superior in withstand voltage capability and deposition resistance property, without using Te.

MODE FOR IMPLEMENTING THE INVENTION

Figure 1:
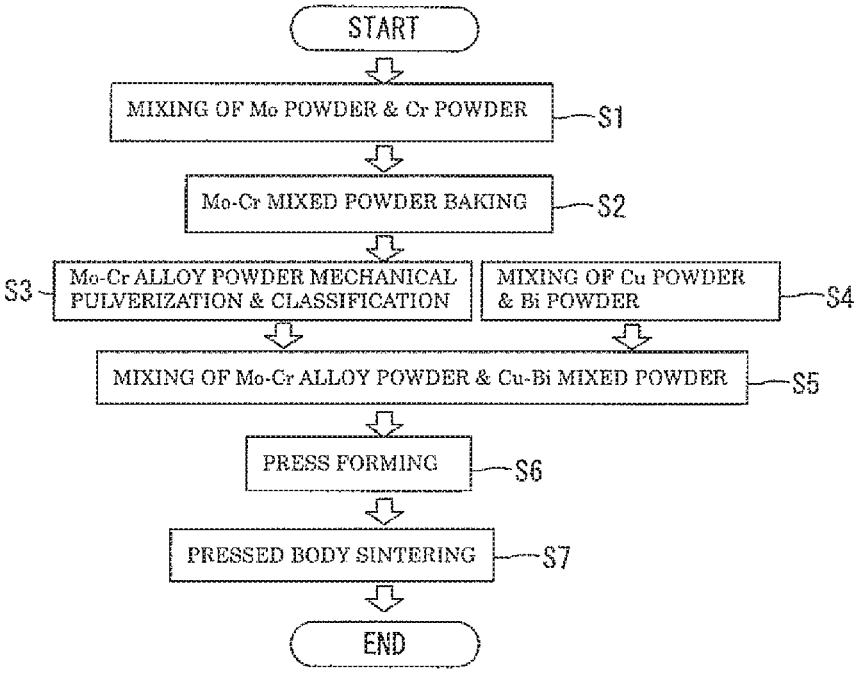
FIG. 1 is a flowchart of an electrode material manufacture method according to an embodiment of the present invention.

An electrode material manufacture method according to an embodiment of the present invention is explained in detail with reference to the drawings. In the explanation of the embodiment, unless otherwise stated, the particle size (median size $d_{50}$), the volume-based relative particle amount, etc. refer to values determined by a laser diffraction-type, particle size distribution measurement apparatus (a company CILAS; CILAS 1090L). Furthermore, in case that the upper limit (or lower limit) of the particle size of a powder is defined, it refers to a powder classified by a sieve having an opening of the upper limit value (or lower limit value) of the particle size.

Prior to the present invention, the inventors prepared an electrode material by a sintering method using a MoCr solid solution powder containing Mo and Cr in a ratio such that Cr is greater than Mo by weight, and a Cu powder (for example, Japanese Patent Application 2015-93765). This electrode material was an electrode material having a texture, in which MoCr alloy was finely dispersed in Cu base material, and having superior withstand voltage capability and deposition resistance property as compared with conventional CuCr electrode materials. Furthermore, when a MoCr solid solution powder containing Mo and Cr in a ratio such that Cr was greater than Mo by weight was used, it resulted in an electrode material with a higher deposition resistance property, as compared with the case of using a MoCr solid solution powder containing Mo and Cr in a ratio such that Cr was less than Mo by weight.

In order to downsize an operation mechanism for conducting opening and closing movements of the electrodes in a vacuum circuit breaker, it is desirable to further improve deposition resistance property to reduce the peeling force when the electrode material has deposited. In order to do that, it is considered to add a low melting metal to the mixed powder of Cu powder and MoCr solid solution powder. In the case of adding a low melting metal, however, packing percentage of the electrode material lowers. Therefore, there is a risk that brazing property between the electrode contact and the electrode rod becomes inferior. Furthermore, tellurium (Te) as a low melting metal is stronger in toxicity as compared with other low melting metals (for example, bismuth (Bi), etc.). In the contact material manufacture step, it is preferable to use a material that is low in toxicity, from the viewpoint of safety and health aspects.

Based on the above-mentioned situation, the inventors conducted an eager study and reached completion of the present invention. As inventions related to the present invention, there are JP Patent Application No. 2015-126086 and JP Patent Application No. 2015-161482. The present invention is an invention relating to a Cu—Cr-heat resistant element (Mo, W, V, etc.)-low melting metal (Bi, etc.) electrode material, composition control technique and is an invention related to a method for manufacturing an electrode material that is excellent in brazing property and superior in withstand voltage capability and deposition resistance property by limiting sintering temperature of the electrode material and particle size of the low melting metal powder to be added to the electrode material. By using an electrode material manufactured by the electrode material manufacture method of the present invention, yield of vacuum interrupters improves, and it becomes possible to downsize vacuum interrupters.

As the heat-resistant element, an element selected from elements, such as molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rf) and ruthenium (Ru), is used singly or in combination. In particular, it is preferable to use Mo, W, Ta, Nb, V or Zr, which is remarkable in the effect of making the Cr particles fine. In the case of using the heat-resistant element as powder, the median size $d_{50}$ of the heat-resistant element powder is adjusted, for example, to 10 μm or less, thereby making Cr-containing particles (containing a solid solution of the heat-resistant element and Cr) fine and uniformly disperse in the electrode material. By containing 1.99-11.96 weight %, more preferably 1.99-3.99 weight %, of the heat-resistant element relative to the electrode material, withstand voltage capability and current breaking capability of the electrode material are improved without lowering mechanical strength and workability. Strictly speaking, the weight of the electrode material in the explanation of the embodiment of the present invention refers to the total value of the heat-resistant element powder, the Cr powder and the Cu powder as raw materials.

As the low melting metal, an element selected from elements such as bismuth (Bi), tin (Sn), selenium (Se) and lead (Pb) is used singly or in combination. If the low melting metal is contained by 0.30-0.50 weight % relative to the electrode material (specifically, a mixed powder prior to sintering), the electrode material is improved in deposition resistance property. In the case of using the low melting metal as a powder, there is used a powder having a median size $d_{50}$ of from 5 μm to 20 μm, more preferably from 5 μm to 10 μm, as the particle size of the low melting metal.

By containing 7.96-47.86 weight %, more preferably 7.96-15.95 weight %, of chromium (Cr) relative to the electrode material, withstand voltage capability and current breaking capability of the electrode material are improved without lowering mechanical strength and workability. In the case of using Cr powder, the median size $d_{50}$ of Cr powder is not particularly limited as long as it is greater than the median size of the heat-resistant element powder. For example, a Cr powder having a median size of 80 μm or less is used.

By containing 39.80-89.73 weight %, more preferably 79.60-89.73 weight %, of copper (Cu) relative to the electrode material, contact resistance of the electrode material is reduced without impairing withstand voltage capability and current breaking capability. By adjusting median size $d_{50}$ of Cu powder, for example, to 100 μm or less, a solid solution powder of the heat-resistant element and Cr is uniformly mixed with Cu powder. In the electrode material to be manufactured by the sintering method, it is possible to freely set the Cu weight ratio by adjusting the amount of Cu powder to be mixed with a solid solution powder of the heat-resistant element and Cr.

The electrode material manufacture method according to the embodiment of the present invention is explained in detail with reference to flow of FIG. 1. The explanation of the embodiment is conducted by showing Mo as an example of the heat-resistant element and Bi as an example of the low melting metal, but it is similar in the case of using other heat-resistant elements and low melting metal powders, too.

In the Mo—Cr mixing step S1, the heat-resistant element powder (e.g., Mo powder) is mixed with Cr powder. The Mo powder and the Cr powder are mixed together such that the weight of the Cr powder becomes greater than the weight of the Mo powder. The Mo powder and the Cr powder are mixed together, for example, in a range that Mo/Cr=1/4 to 1/1 (Mo:Cr=1:1 is not included) by weight.

In the baking step S2, a mixed powder of Mo powder and Cr powder is baked. In the baking step S2, for example, a compact of the mixed powder is retained in a vacuum atmosphere at a temperature of 900-1200° C. for 1 to 10 hours to obtain MoCr sintered body. In case that the weight of the Cr powder is greater than that of the Mo powder in the mixed powder, there remains Cr that does not form a solid solution with Mo after the baking. Therefore, there is obtained a porous body (MoCr sintered body) containing a MoCr alloy resulting from solid phase diffusion of Cr into Mo and the remaining Cr particles.

In the pulverization and classification step S3, the MoCr sintered body obtained by the sintering step S2 is pulverized by a ball mill, etc. MoCr powder to be obtained by pulverizing the MoCr sintered body is classified by a sieve having, for example, an opening of 200 μm, more preferably an opening of 90 μm, to remove particles having large particle sizes. In the pulverization and classification step S3, it is preferable to conduct the classification such that the volume-based relative particle amount of particles of 90 μm or less becomes 90% or greater in the MoCr powder. The pulverization in the pulverization and classification step S3 is conducted, for example, for two hours per 1 kg of the MoCr sintered body. The average particle size of the MoCr powder after the pulverization becomes different, depending on the mixing ratio of Mo powder and Cr powder.

In the low melting metal powder mixing step S4, the Cu powder is mixed with the low melting metal powder (for example, Bi powder). In the electrode material production step according to the after-mentioned Comparative Example 1, in order to prevent aggregation of the Cr powder and the Te powder, there are separate mixing steps, that is, (1) the step of mixing the Cu powder and the Te powder, and (2) the step of mixing the CuTe mixed powder and the Cr powder. Therefore, even in the case of using the MoCr alloy powder, similarly, there is separately conducted the step of mixing the Cu powder and the low melting metal powder. Therefore, in a condition in which aggregation of the Cu powder and the low melting metal powder does not occur, it is optional to mix the Cu powder and the low melting metal powder into the MoCr powder in the Cu mixing step S5 to be explained in the following.

In the Cu mixing step S5, the MoCr powder obtained by the pulverization and classification step S3 is mixed with the Cu powder, into which the low melting metal powder has been mixed, which has been obtained by the low melting metal powder mixing step S4.

In the press forming step S6, forming of a mixed powder obtained by the Cu mixing step S5 is conducted. If a compact is manufactured by a press molding, it is not necessary to conduct machining on the compact after the sintering. Therefore, it can directly be used as an electrode (electrode contact material).

In the primary sintering step S7, a compact obtained by the press forming step S6 is sintered to manufacture an electrode material. In the primary sintering step S6, sintering of the compact is conducted, for example, in a non-oxidizing atmosphere (hydrogen atmosphere, vacuum atmosphere, etc.) at a temperature that is lower than melting point of Cu, specifically at a temperature of from 1000° C. to 1035° C., more preferably from 1010° C. to 1030° C. Sintering time of the primary sintering step S7 is suitably set in accordance with the sintering temperature. For example, the sintering time is set at two hours or longer.

Figure 2:
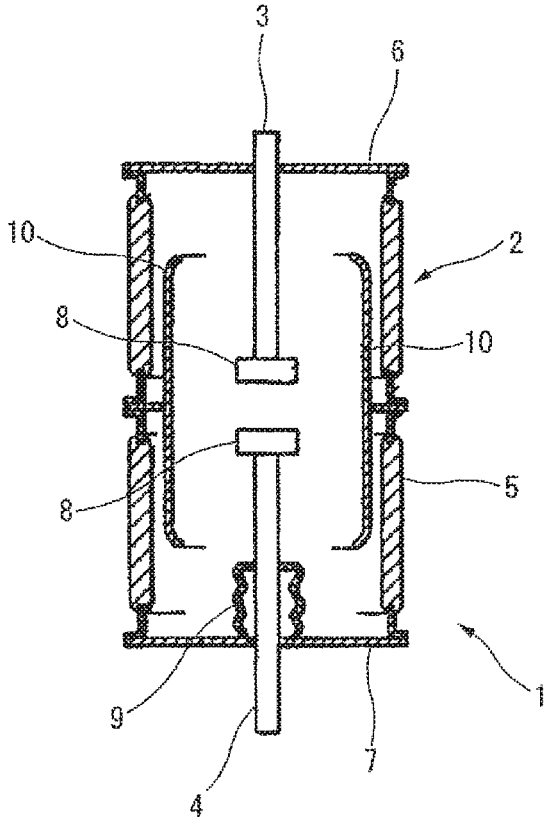
FIG. 2 is a schematic sectional view showing a vacuum interrupter having the electrode material according to the embodiment of the present invention.

By using the electrode material manufactured by the electrode material manufacture method according to the embodiment of the present invention (hereinafter, referred to as the electrode material of the present invention), it is possible to construct a vacuum interrupter. As shown in FIG. 2, a vacuum interrupter 1 having the electrode material of the present invention has a vacuum container 2, a fixed electrode 3, a movable electrode 4, and a main shield 10.

The vacuum container 2 is formed by sealing both opening end portions of an insulating sleeve 5 with a fixed-side end plate 6 and a movable-side end plate 7, respectively.

The fixed electrode 3 is fixed in a condition that it passes through the fixed-side end plate 6. One end of the fixed-side electrode 3 is fixed to be opposed to one end of the movable electrode 4 in the vacuum container 2. An end portion of the fixed electrode 3, which is opposed to the movable electrode, is formed with an electrode contact material 8, which is the electrode material of the present invention. Electrode contact material 8 is joined to an end portion of the fixed electrode 3 by a brazing material (e.g., Ag—Cu based brazing material).

The movable electrode 4 is provided at the movable-side end plate 7. The movable electrode 4 is provided to be coaxial with the fixed electrode 3. The movable electrode 4 is moved in an axial direction by an opening/closing means not shown in the drawings, thereby conducting an opening or closing between the fixed electrode 3 and the movable electrode 4. An end portion of the movable electrode 4, which is opposed to the fixed electrode 3, is formed with an electrode contact material 8. The electrode contact material 8 is joined to an end portion of the movable electrode 4 by brazing material. Bellows 9 are provided between the movable electrode 4 and the movable-side end plate 7. Therefore, while vacuum of the inside of the vacuum container 2 is maintained, the movable electrode 4 is moved in a vertical direction to conduct an opening/closing between the fixed electrode 3 and the movable electrode 4.

The main shield 10 is provided to cover a contact portion between the electrode contact material 8 of the fixed electrode 3 and the electrode contact material 8 of the movable electrode 4, thereby protecting the insulating sleeve 5 from an are that occurs between the fixed electrode 3 and the movable electrode 4.

Examples 1-3 & Reference Example 1

Electrode materials according to Examples 1-3 and Reference Example 1 were prepared in accordance with the flow shown in FIG. 1. The electrode materials of Examples 1-3 and Reference Example 1 are electrode materials prepared by mixing Cu powder and Bi powder into MoCr powder in ratios of Cu:MoCr=4:1 and CuCrMo:Bi=100:0.3.

As the raw materials of the electrode materials of Examples 1-3 and Reference Example 1, Mo powder having a median size $d_{50}$ of 10 μm or less, Bi powder having a median size $d_{50}$ of 9 μm produced by atomization process, termite Cr powder having a median size $d_{50}$ of 80 μm or less and Cu powder having a median size $d_{50}$ of 100 μm or less were used. The electrode materials according to Examples 4-6, Comparative Example 1 and Reference Examples 2-14 were also prepared by using the same raw materials.

Firstly, Mo powder and Cr powder were mixed together in a weight ratio of Mo:Cr=1:4, and it was sufficiently mixed by using a V-type mixer until becoming homogeneous.

After mixing, this mixed powder of Mo powder and Cr powder was transferred into an alumina container and subjected to a heat treatment in a vacuum furnace (non-oxidizing atmosphere) at 1150° C. for six hours. A porous body as the obtained reaction product was pulverized and then classified by a sieve having an opening of 90 μm, thereby obtaining a MoCr powder under 90 μm.

Next, a mixed powder of Bi powder and Cu powder obtained by the low melting metal powder mixing step S4 was mixed into the MoCr powder in weight ratios of Cu:MoCr=4:1 and CuCrMo:Bi=100:0.3, followed by a sufficient mixing using a V-type mixer until becoming homogeneous. The obtained mixed powder was formed by a press mold forming into a compact. This compact was sintered in a non-oxidizing atmosphere for two hours at 1015° C. (Example 1), 1025° C. (Example 2), 1035° C. (Example 3) and 1050° C. (Reference Example 1).

Examples 4-6 and Reference Example 2

The electrode materials of Examples 4-6 and Reference Example 2 are electrode materials prepared by mixing Bi powder and Cu powder into the MoCr powder in ratios of Cu:MoCr=4:1 and CuCrMo:Bi=100:0.5. That is, the electrode materials of Examples 4-6 and Reference Example 2 are electrode materials prepared by the same method as that of Example 1, except that the Bi powder mixing amount and the compact sintering temperature were different. Therefore, explanations of the same steps as those of the electrode material manufacture method of Example 1 are omitted.

Electrode materials of Examples 4-6 and Reference Example 2 were prepared in accordance with the flow of FIG. 1. In the low melting metal powder mixing step S4, Cu powder and Bi powder were mixed together to make a predetermined ratio. In the Cu mixing step S5, a mixed powder of Bi powder and Cu powder obtained by the low melting metal powder mixing step S4 was mixed into the MoCr powder obtained by the pulverization and classification step S3 in weight ratios of Cu:MoCr=4:1 and CuCrMo:Bi=100:0.5, followed by a sufficient mixing using a V-type mixer until becoming homogeneous. The obtained mixed powder was formed by a press mold forming into a compact. This compact was sintered in a non-oxidizing atmosphere for two hours at 1015° C. (Example 4), 1025° C. (Example 5), 1035° C. (Example 6) and 1050° C. (Reference Example 2).

Comparative Example 1

The electrode material of Comparative Example 1 is an electrode material prepared by mixing Cu powder, Cr powder and Te powder in weight ratios of Cu:Cr=4:1 and CuCr:Te=100:0.05, followed by a sufficient mixing using a V-type mixer until becoming homogeneous, then making a compact and then sintering at 1025° C. for two hours.

Reference Examples 3-6

Electrode materials of Reference Examples 3-6 are electrode materials each using Te as the low melting metal powder. That is, the electrode materials of Reference Examples 3-6 are electrode materials prepared by the same method as that of Example 1, except in that Te powder was used in place of Bi powder and that the sintering temperature of the compact is different. Therefore, detailed explanations of the same steps as those of the electrode material of Example 1 are omitted.

The electrode materials of Reference Examples 3-6 were prepared in accordance with the flow of FIG. 1. In the low melting metal powder mixing step S4, Cu powder and Te powder were mixed together to make a predetermined ratio. As the Te powder, a powder having a median size $d_{50}$ of 48 μm was used. In the Cu mixing step S5, a mixed powder of Te powder and Cu powder obtained by the low melting metal powder mixing step S4 was mixed into the MoCr powder obtained by the pulverization and classification step S3 in weight ratios of Cu:MoCr=4:1 and CuCrMo:Te=100:0.1. The obtained mixed powder was formed by a press mold forming into a compact. This compact was sintered in a non-oxidizing atmosphere for two hours at 1015° C. (Reference Example 3), 1025° C. (Reference Example 4), 1035° C. (Reference Example 5) and 1050° C. (Reference Example 6).

Reference Examples 7-10

Electrode materials of Reference Examples 7-10 are electrode materials prepared by mixing Bi powder and Cu powder into MoCr powder in the Cu mixing step S5 in ratios of Cu:MoCr=4:1 and CuCrMo:Bi=100:0.05. That is, the electrode materials of Reference Examples 7-10 are electrode materials prepared by the same method as that of Example 1, except in that the Bi powder mixing amount and the compact sintering temperature are different. Therefore, explanation of the same step as that of the electrode material manufacture method of Example 1 is omitted.

The electrode materials of Reference Examples 7-10 were prepared in accordance with the flow of FIG. 1. In the low melting metal powder mixing step S4, Cu powder and Bi powder were mixed together to make a predetermined ratio. In the Cu mixing step S5, a mixed powder of Bi powder and Cu powder obtained by the low melting metal powder mixing step S4 was mixed into the MoCr powder obtained by the pulverization and classification step S3 in weight ratios of Cu:MoCr=4:1 and CuCrMo:Bi=100:0.05, followed by a sufficient mixing using a V-type mixer until becoming homogeneous. The obtained mixed powder was formed by a press mold forming into a compact. This compact was sintered in a non-oxidizing atmosphere for two hours at 1015° C. (Reference Example 7), 1025° C. (Reference Example 8), 1035° C. (Reference Example 9) and 1050° C. (Reference Example 10).

Reference Examples 11-14

Electrode materials of Reference Examples 11-14 are electrode materials prepared by mixing Bi powder and Cu powder into MoCr powder in ratios of Cu:MoCr=4:1 and CuCrMo:Bi=100:0.1 in the Cu mixing step S5. That is, the electrode materials of Reference Examples 11-14 are electrode materials prepared by the same method as that of Example 1, except in that the Bi powder mixing amount and the compact sintering temperature are different. Therefore, explanation of the same step as that of the electrode material manufacture method of Example 1 is omitted.

The electrode materials of Reference Examples 11-14 were prepared in accordance with the flow of FIG. 1. In the low melting metal powder mixing step S4, Cu powder and Bi powder were mixed together to make a predetermined ratio. In the Cu mixing step S5, a mixed powder of Bi powder and Cu powder obtained by the low melting metal powder mixing step S4 was mixed into the MoCr powder obtained by the pulverization and classification step S3 in weight ratios of Cu:MoCr=4:1 and CuCrMo:Bi=100:0.1, followed by a sufficient mixing using a V-type mixer until becoming homogeneous. The obtained mixed powder was formed by a press mold forming into a compact. This compact was sintered in a non-oxidizing atmosphere for two hours at 1015° C. (Reference Example 11), 1025° C. (Reference Example 12), 1035° C. (Reference Example 13) and 1050° C. (Reference Example 14).

TABLE 1

| | Classification | Sintering temp. | Packing percentage | Brinell hardness | Withstand voltage capability |
|---|---|---|---|---|---|
| | Com. Ex. 1 | 1025° C. | 93% | 54 | 1.0 |
| | Ref. Ex. 3 | 1015° C. | 90% | 53 | — |
| | Ref. Ex. 4 | 1025° C. | 91% | 54 | 1.4 |
| | Ref. Ex. 5 | 1035° C. | 92% | 56 | — |
| | Ref. Ex. 6 | 1050° C. | 85% | 42 | — |
| 0.05 wt % | Ref. Ex. 7 | 1015° C. | 93% | 58 | — |
| | Ref. Ex. 8 | 1025° C. | 93% | 58 | — |
| | Ref. Ex. 9 | 1035° C. | 94% | 61 | — |
| | Ref. Ex. 10 | 1050° C. | 94% | 61 | — |
| 0.1 wt % | Ref. Ex. 11 | 1015° C. | 92% | 57 | — |
| | Ref. Ex. 12 | 1025° C. | 92% | 58 | — |
| | Ref. Ex. 13 | 1035° C. | 94% | 60 | — |
| | Ref. Ex. 14 | 1050° C. | 92% | 57 | — |
| 0.3 wt % | Example 1 | 1015° C. | 91% | 53 | — |
| | Example 2 | 1025° C. | 91% | 52 | 1.2 |
| | Example 3 | 1035° C. | 91% | 52 | — |
| | Ref. Ex. 1 | 1050° C. | 88% | 46 | — |
| 0.5 wt % | Example 4 | 1015° C. | 90% | 50 | — |
| | Example 5 | 1025° C. | 90% | 50 | — |
| | Example 6 | 1035° C. | 89% | 50 | — |
| | Ref. Ex. 2 | 1050° C. | 86% | 43 | — |

Figure 3:
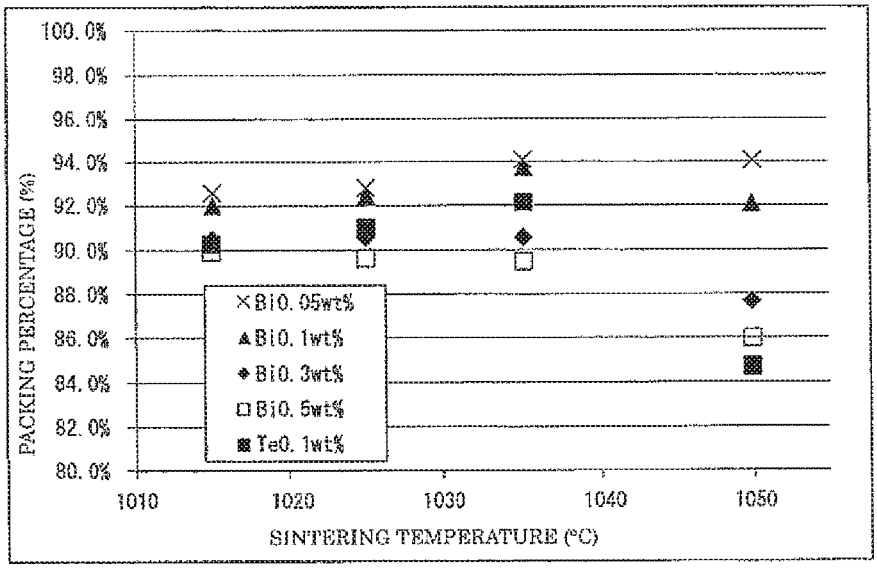
FIG. 3 is a characteristic graph showing a relationship between the sintering temperature and the packing percentage of the electrode material.
Figure 4:
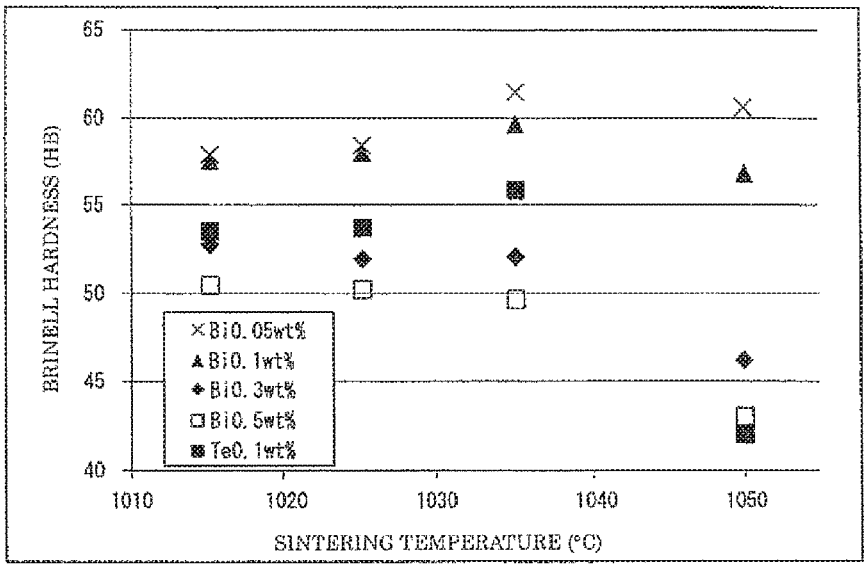
FIG. 4 is a characteristic graph showing a relationship between the sintering temperature and the Brinell hardness of the electrode material.

Table 1 shows characteristics of the electrode materials of Examples 1-6, Comparative Example 1, and Reference Examples 1-14. Furthermore, FIG. 3 is a graph showing the change of packing percentage of the electrode material relative to the sintering temperature. FIG. 4 is a graph showing the change of Brinell hardness of the electrode material relative to the sintering temperature. Density of the sintered body was actually measured, and packing percentage was calculated from (measured density/theoretical density)×100(%). Furthermore, brazing property was evaluated in terms of two points by conducting a brazing with Ag—Cu based brazing material between the electrode material and a lead to see if fillet is formed or not, and by hitting the brazed electrode material with a hammer to see if the electrode material comes off the lead or not. That is, a good brazing with the formation of fillet is conducted if a brazing material (Ag) is brazed in a manner that the brazing material is not absorbed by a large amount into the electrode material at the brazing. In the electrode materials of Examples 1-6, packing percentage was high, and dispersion of packing percentage was small. Therefore, in all of the electrode materials, brazing property was good. In contrast with this, in the electrode materials of Reference Examples 1 and 2, packing percentage was low, resulting in the brazing material being absorbed into the electrode and the brazing property being inferior.

As shown in FIG. 3 and FIG. 4, in case that the amount of Bi addition is 0.05 wt % or 0.1 wt %, even if the sintering temperature is made high (1050° C.), lowering of packing percentage and Brinell hardness cannot be found. This is considered that the effect of adding the low melting metal (e.g., Bi) is not reflected in physical properties of the electrode material as a result of that the added Bi was almost evaporated at low sintering temperatures. Brinell hardness becomes a standard for judging the deposition resistance property and contributes to the withstand voltage capability and the deposition resistance property. That is, it is considered that, since the Bi addition effect is not reflected in physical properties, the electrode materials of Reference Examples 7-10 (Bi: 0.05 wt %) and Reference Examples 11-14 (Bi: 0.1 wt %) are inferior to the electrode material of Comparative Example 1. Furthermore, in case that the amount of Bi added was 0.3 wt % and 0.5 wt %, it was confirmed to have lowering of the packing percentage and Brinell hardness by increasing sintering temperature (1050° C.). It is considered that this lowering of packing percentage and Brinell hardness was caused by evaporation of Bi. This makes it possible to judge that the Bi addition effect is reflected in physical properties of the electrode material. As being lower in Brinell hardness as compared with Reference Example 4 (CuCrMoTe electrode: Te 0.1 wt %) superior in deposition resistance property, it is considered that the electrode materials of Examples 1-3 (Bi: 0.3 wt %) and Examples 4-6 (Bi: 0.5 wt %) are equal to or greater than the electrode material of Reference Example 4 (Te: 0.1 wt %).

That is, in the case of adding a low melting metal to the electrode material, it is considered that the amount of the lower melting metal to be evaporated increases by increasing the sintering temperature. However, in case that the amount of Bi added is 0.10 wt % or less, it is considered that the amount of Bi added is insufficient, and Bi is evaporated in the process of the primary sintering step S7, thereby not obtaining the effect of improving the deposition resistance property. Therefore, setting the amount of Bi added at 0.30 wt % or greater makes it possible to manufacture an electrode material showing a deposition resistance property that is equal to or greater than that of Te-added electrode materials superior in deposition resistance property.

On the other hand, as the amount of low melting metal addition in an electrode material increases, the occurrence of vacancies in the electrode material increases, thereby lowering density of the electrode material and withstand voltage capability of the electrode material and increasing contact resistance (for example, see paragraph [0081] of Japanese Patent Application No. 2015-161482). Therefore, it is possible by setting the amount of Bi to be added to the electrode material at 0.50 wt % or less to suppress lowering of density of the electrode material and to manufacture an electrode material superior in withstand voltage capability.

Furthermore, if the sintering temperature is set at 1035° C. or higher, packing percentage and Brinell hardness of the electrodes, to which Bi was added by 0.3 wt % or more, lower abruptly by two factors of (1) evaporation of Bi as a low melting metal and (2) a diffusion reaction of the remaining Cr and Mo (for example, see paragraph [0074] of Japanese Patent Application No. 2015-126086). Like the electrode materials of Reference Example 1 and Reference Example 2, in case that packing percentage is 88% or less, brazing property becomes problematic (the brazing material is absorbed into the electrode). Therefore, it is considered as being optimum that the sintering temperature of an electrode, to which Bi was added by 0.30 wt % or more, is set at 1035° C. or lower. In case that the sintering temperature is lower than 1000° C., sintering of the material itself does not proceed, thereby lowering packing percentage and material strength. Therefore, it is possible to manufacture an electrode material that is superior in withstand voltage capability and brazing property by setting the sintering temperature at 1000° C. or higher and 1035° C. or lower, more preferably 1010° C. or higher and 1035° C. or lower.

Furthermore, the inventors have obtained findings that, in the case of adding a low melting metal, it is possible by using a classified powder to reduce the size of the inside vacancies to be generated by evaporation of the low melting metal in the sintering step of the electrode, thereby increasing packing percentage (for example, see paragraphs [0084] and [0085] of Japanese Patent Application No. 2015-161482). Therefore, it is possible to manufacture an electrode material high in packing percentage by setting the median size of low melting metal particles in the low melting metal powder at 5 μm or greater and 20 μm or less, more preferably at 5 μm or greater and 10 μm or less. In general, it is known that, in the case of mixing fine particles with another material that is greatly different in particle size, the fine particles aggregate. However, as a result of analyzing sectional textures of the electrode materials of Examples 1-6 and Reference Examples 1, 2 and 7-14, aggregation of Bi was not found.

Thus, in the electrode materials of Examples 1-6, packing percentage was 89% or higher, dispersion of packing percentage was small, and a stable brazing was possible. Furthermore, as a result of conducting an impulse withstand voltage test on the electrode material of Comparative Example 1, the electrode material of Reference Example 4 and the electrode material of Example 2, the electrode material of Example 1 is understood as being an electrode material that is sufficiently superior in withstand voltage capability, since it is superior to the electrode material of Comparative Example 1, although being inferior a little to the electrode material of Reference Example 4. Furthermore, as shown in FIG. 4, the electrode materials of Examples 1-6 are electrode materials that are 50 or greater in Brinell hardness (electrode materials superior in withstand voltage capability), which are obtained by controlling the Bi powder particle size, the amount of Bi added and the sintering temperature. Furthermore, these electrode materials are considered to have deposition resistance properties equal to or greater than that of Comparative Example 1, since they are equal to or less than Comparative Example 1 in Brinell hardness. Similarly, other Examples have also been confirmed to be electrode materials that are superior to the electrode material of Comparative Example 1 in withstand voltage capability and deposition resistance property.

The electrode material manufacture method mentioned above according to the embodiments of the present invention makes it possible to manufacture an electrode material that is superior to current CuCr electrodes in withstand voltage capability and deposition resistance property by sintering a powder at 1010° C. or higher and 1035° C. or lower that was prepared by adding 0.30 wt % to 0.50 wt % of a Bi powder having a median size of 5 μm or greater and 20 μm or less, more preferably 5 μm or greater and 10 μm or less, to a mixed powder of a solid solution powder of the heat-resistant element and Cr and a Cu powder.

In the electrode material manufacture method using a Te powder (melting point: 450° C.), it was possible to obtain an electrode material that is superior in deposition resistance property and brazing property by adjusting either the particle size of Te powder or the sintering temperature while not lowering withstand voltage capability and current breaking capability. It was, however, difficult to obtain the effect of deposition resistance property with no appropriate adjustment of both the particle size and the sintering temperature in the case of one that is particularly low in melting point like Bi (melting point: 270° C.) among low melting metals. Furthermore, in the case of using a low melting metal having a melting point lower than that of Te, since a large amount of the low melting metal is evaporated in the sintering step, it is preferable that the low melting metal to be added to the electrode material is 0.3 wt % or greater and 0.50 wt % or less.

Furthermore, the electrode manufacture method according to the embodiments of the present invention makes it possible to obtain an electrode material having a withstand voltage capability and a deposition resistance property that are comparable to those of CuCrMoTe electrodes by using a low melting metal such as Bi that is lower in toxicity than Te. Therefore, this manufacture method makes it possible to manufacture an electrode material that is superior in deposition resistance property and withstand voltage capability by using a low melting metal such as Bi as a metal that is alternative to Te when Te is included from now on in foreign regulations such as REACH.

That is, the electrode material manufacture method according to the embodiments of the present invention makes it possible to provide an electrode material for vacuum interrupters, which is superior in deposition resistance property and withstand voltage capability, by using an alternative Te metal material without lowering superior withstand voltage property and deposition resistance property of CuCrMoTe electrode materials.

Furthermore, the obtained electrode material has a packing percentage of 89% or higher (90% or higher in most cases) and a small dispersion of packing percentage. Therefore, yield of the electrode material is improved, and brazing becomes easy.

Figure 5:
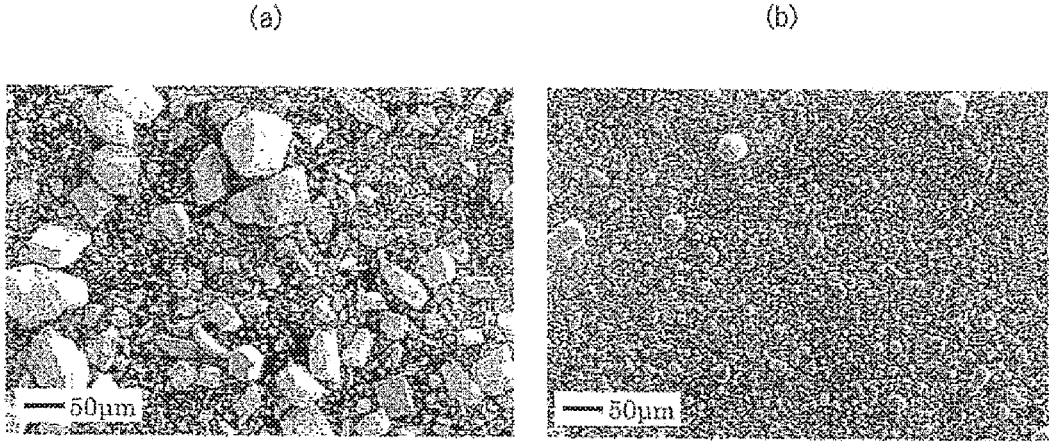
FIG. 5(*a*) is an enlarged view of a Te powder, and FIG. 5(*b*) is an enlarged view of a Bi powder.

Furthermore, the use of a Bi raw material powder manufactured by atomization process makes it possible to manufacture an electrode material that is further superior in withstand voltage capability and deposition resistance property. This is because, as shown in FIG. 5, as compared with Te powder, it has a smaller average particle size and a spherical particle shape, thereby achieving a good dispersion property when mixed with Cu powder. That is, a low melting metal powder manufactured by atomization process is easily homogeneously mixed with Cu powder (and Cr-heat resistant element powder) and makes it possible to manufacture an electrode material that is superior in withstand voltage capability and deposition resistance property.

The present invention is not limited to the embodiments. It is possible to suitably change the design in a range of not impairing characteristics of the invention, and the embodiment with the changed design also belongs to the technical scope of the present invention.

Furthermore, the present invention is an invention related to an electrode material manufacture method, but an electrode material manufactured by this manufacture method also belongs to the technical scope of the present invention. Furthermore, the use of this electrode material as a contact material of a fixed electrode or a movable electrode makes it possible to constitute a vacuum interrupter having an electrode contact that is superior in withstand voltage capability and deposition resistance property by using an alternative Te as a raw material.

The invention claimed is:

1. A method for manufacturing an electrode material, comprising the steps of:

(a) sintering a mixed powder containing a Cr powder and a powder of at least one heat-resistant element selected from the group consisting of Mo, W, Ta, Nb, V, and Zr, the mixed powder containing the Cr and the heat-resistant element in a ratio such that the Cr is greater than the heat-resistant element by weight, thereby making a solid solution of the Cr and the heat-resistant element;

(b) pulverizing the solid solution of the Cr and the heat-resistant element to obtain a solid solution powder of the Cr and the heat-resistant element, and then classifying the solid solution powder of the Cr and the heat-resistant element such that a volume-based relative particle amount of particles having a particle size of 90 μm or less becomes 90% or greater;

(c) mixing the classified solid solution powder of the Cr and the heat-resistant element, a Cu powder having a median size of 100 μm or less, and a low melting metal powder having a median size of from 5 μm to 20 μm, the low melting metal powder being at least one selected from the group consisting of Bi, Sn, Se and Pb, such that the electrode material contains 39.80 to 89.73 weight % of the Cu, 7.96 to 47.86 weight % of the Cr, 1.99 to 11.96 weight % of the heat-resistant element, and 0.30 to 0.50 weight % of the low melting metal powder; and (d) sintering a compact prepared by pressing a mixed powder obtained by the mixing step, at a temperature of from 1010° C. to 1035° C., the sintering of step (d) being free from applying pressure to the compact, wherein the at least one heat-resistant element comprises Mo, and the low melting powder comprises Bi.

2. The method for manufacturing an electrode material as claimed in claim 1, wherein the low melting metal powder has a median size of from 5 μm to 10 μm.

3. The method for manufacturing an electrode material as claimed in claim 1, wherein the low melting metal powder is a powder produced by an atomization process.

4. The method for manufacturing an electrode material as claimed in claim 2, wherein the low melting metal powder is a powder produced by an atomization process.

* * * * *